US006952894B1

(12) United States Patent
Vieweg

(10) Patent No.: US 6,952,894 B1
(45) Date of Patent: Oct. 11, 2005

(54) CARTRIDGE MAGAZINE SYSTEM

(76) Inventor: Thomas Vieweg, 777 Mount Ave., Wyandanch, NY (US) 11798

( * ) Notice: Subject to any disclaimer, the term of this patent is extended or adjusted under 35 U.S.C. 154(b) by 0 days.

(21) Appl. No.: 10/664,389

(22) Filed: Sep. 17, 2003

(51) Int. Cl.[7] ..... F41A 9/65
(52) U.S. Cl. ..... 42/50; 89/33.1
(58) Field of Search ..... 42/50, 49.01, 7; 89/33.1, 34

(56) References Cited

U.S. PATENT DOCUMENTS

| | | | | | |
|---|---|---|---|---|---|
| 283,122 | A | * | 8/1883 | Lewis | 42/50 |
| 627,824 | A | * | 6/1899 | Lee | 42/50 |
| 922,497 | A | * | 5/1909 | Mauser | 42/7 |
| 3,043,198 | A | * | 7/1962 | Darsie et al. | 89/33.1 |
| 3,158,947 | A | * | 12/1964 | Menneking et al. | 42/50 |
| 3,577,860 | A | * | 5/1971 | Jestrabek | 42/50 |
| 3,880,045 | A | * | 4/1975 | Clark | 89/9 |
| 4,142,313 | A | * | 3/1979 | Musgrave | 42/1.02 |
| 5,345,660 | A | * | 9/1994 | Howard | 42/49.1 |
| 6,560,907 | B1 | * | 5/2003 | Vieweg | 42/50 |

FOREIGN PATENT DOCUMENTS

| | | | | |
|---|---|---|---|---|
| AT | 200034 | * | 10/1958 | 42/7 |
| GB | 275606 | * | 10/1927 | 42/50 |
| GB | 377840 | * | 8/1932 | 42/50 |
| GB | 584743 | * | 1/1947 | 42/50 |
| NO | 4378 | * | 7/1895 | 42/7 |

OTHER PUBLICATIONS

The American Rifleman; vol. 123; #9; p. 12;Sep. 1975.*

* cited by examiner

*Primary Examiner*—Stephen M. Johnson
(74) *Attorney, Agent, or Firm*—Edward P. Dutkiewicz

(57) ABSTRACT

A cartridge magazine system comprises a case. The case has a hollow generally rectilinear configuration with two side faces and a front face and a flat rear face with the case having a base end with a base plate and an open upper end thereby forming an interior recess. A spring has an upper end and a lower end positioned on the base plate. A follower is positioned within the recess upon the spring with a central section having a front and a rear. Lastly, a dimple in a generally hemispherical configuration extends upwardly from the central section and is located to thereby fit into the annular recess of a bullet there above.

2 Claims, 3 Drawing Sheets

FIG 3
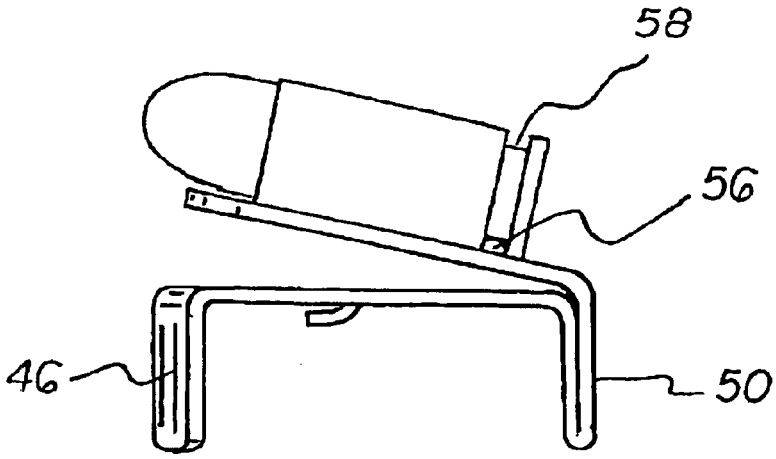
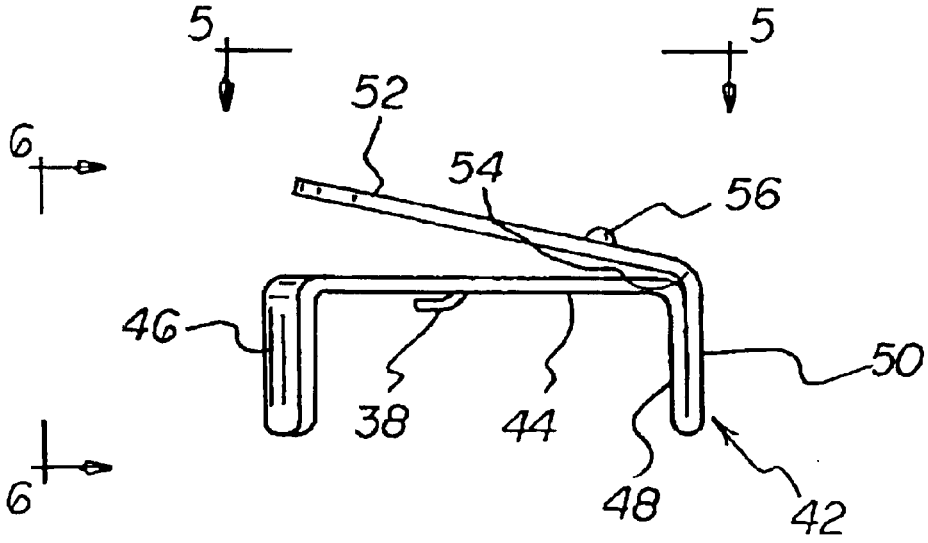
FIG 4

FIG 5
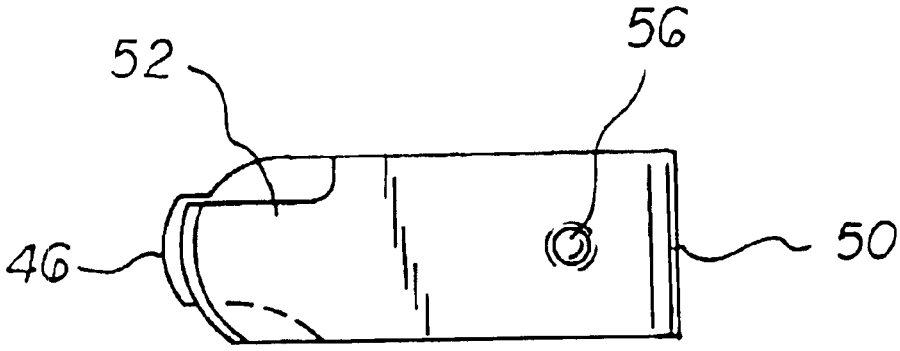
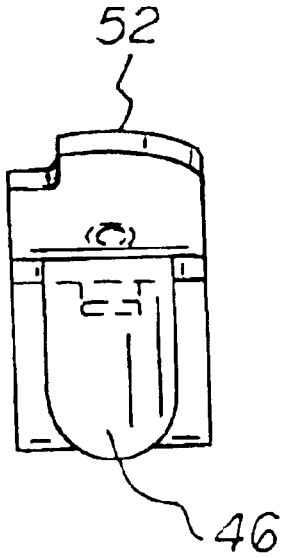
FIG 6

CARTRIDGE MAGAZINE SYSTEM

BACKGROUND OF THE INVENTION

1. Field of the Invention

The present invention relates to a cartridge magazine system and more particularly pertains to extending the life of magazines.

2. Description of the Prior Art

The use of magazine systems of known designs and configurations is known in the prior art. More specifically, magazine systems of known designs and configurations previously devised and utilized for the purpose of extending the life of magazines through known methods and configurations are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,446,645 to Kelsey, Jr., et al discloses a cartridge magazine and follower for autoloading firearms while my prior invention of U.S. Pat. No. 6,560,907 discloses a cartridge magazine system. While these devices fulfill their, particular objectives and requirements, the aforementioned patents do not describe a cartridge magazine system that allows users to extend the life of a magazine.

In this respect, the cartridge magazine system according to the present invention substantially departs from the conventional concepts and designs of the prior art, and in doing so provides an apparatus primarily developed for the purpose of extending the life of a magazine.

Therefore, it can be appreciated that there exists a continuing need for a new and improved cartridge magazine system which allows users to extend the life of magazines. In this regard, the present invention substantially fulfills this need.

SUMMARY OF THE INVENTION

In view of the foregoing disadvantages inherent in the known types of magazine systems of known designs and configurations now present in the prior art, the present invention provides an improved cartridge magazine system. As such, the general purpose of the present invention, which will be described subsequently in greater detail, is to provide a new and improved cartridge magazine system and method which has all the advantages of the prior art and none of the disadvantages.

To attain this, the present invention essentially comprises a case. The case is fabricated of a heat treated stainless steel. The case is in a hollow generally rectilinear configuration. The case has two flat parallel side faces, a rounded front face and a flat rear face. The case has a base end with a base plate and an open upper end. The base plate is formed in a flat generally rectangular configuration. The base plate is coupled to the base end to close the base end. In this manner an interior recess within the case is formed. The upper ends of the side faces have a radial bevel to form a lip on both sides. In this manner the opening into the recess of the case is restricted.

Next provided is a coil spring. The coil spring has an upper end and a lower end. The upper and lower ends are positioned on the base plate and sized to be slightly longer than height of the interior recess of the case. The central portion has a downwardly extending finger for positioning the spring.

Provided next is a follower. The follower is positioned within the recess upon the spring. The follower is fabricated of a heat treated stainless steel and is sufficiently thin to provide a spring-like resilience. The follower has a central section. The central section has a downwardly extending front leg. This front leg is curved to conform to the shape of the rounded front face of the case terminating in an arcuate lowermost extent. The central section also has a downwardly extending flat rear leg which conforms to the shape of the flat rear face of the case. The front leg and the central portion are less wide than the rear leg and the central section. The front and rear legs are adapted to smoothly slide downwardly without binding within the case with the addition of bullets to the recess and the compression of the spring. The front and rear legs are further adapted to smoothly slide upwardly without binding within the case with the removal of bullets from the case and the force of the spring.

The lower end of the rear leg has a 180 degree bend with an upwardly extending portion. The upwardly extending portion terminates in an inwardly extending portion. The inwardly extending portion overlays the central portion and has a supplemental bend between the upwardly extending portion and an inwardly extending portion. The inwardly extending portion is of between about 100 degrees and 105 degrees when not compressed. The inwardly extending portion is resiliently movable into facing contact with the central portion when bullets are positioned within the recess.

Provided last is a dimple in a generally hemispherical configuration having a diameter of about 0.090 inches and a height of about 0.085 inches. The dimple extends upwardly from the central section of the follower and is equally spaced laterally from the side faces of the case and the side edges of the central section. The dimple is located about 0.300 inches from the rear leg of the follower, to thereby fit into the annular recess of a bullet there above.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved cartridge magazine system which has all of the advantages of the prior art magazine systems of known designs and configurations and none of the disadvantages.

It is another object of the present invention to provide a new and improved long life cartridge magazine system which may be easily and efficiently manufactured and marketed.

It is further an object of the present invention to provide a new and improved cartridge magazine system which is of durable and reliable constructions.

An even further object of the present invention is to provide a new and improved cartridge magazine system which is susceptible of a low cost of manufacture with regard to both materials and labor, and which accordingly is then susceptible of low prices of sale to the consuming public, thereby making such cartridge magazine system economically available to the buying public.

Even still another object of the present invention is to extend the life of a cartridge magazine system.

Lastly, it is an object of the present invention to provide a new and improved cartridge magazine system comprising a case. The case has a hollow generally rectilinear configuration with two side faces and a front face and a flat rear face with the case having a base end with a base plate and an open upper end thereby forming an interior recess. A spring has an upper end and a lower end positioned on the base plate. A follower is positioned within the recess upon the spring with a central section having a front and a rear. Lastly, a dimple in a generally hemispherical configuration extends upwardly from the central section and is located to thereby fit into the annular recess of a bullet there above.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the follower shown in FIGS. 1 and 2.

FIG. 4 is a side elevational view of the follower shown in FIG. 2 but without a bullet.

FIG. 5 is a top plan view of the follower shown in FIG. 3 taken along line 5—5 of FIG. 4.

FIG. 6 is an end elevational view of the follower shown in the prior Figures taken along line 6—6 of FIG. 4.

The same reference numerals refer to the same parts throughout the various Figures.

DESCRIPTION OF THE PREFERRED EMBODIMENT

Figure 1:
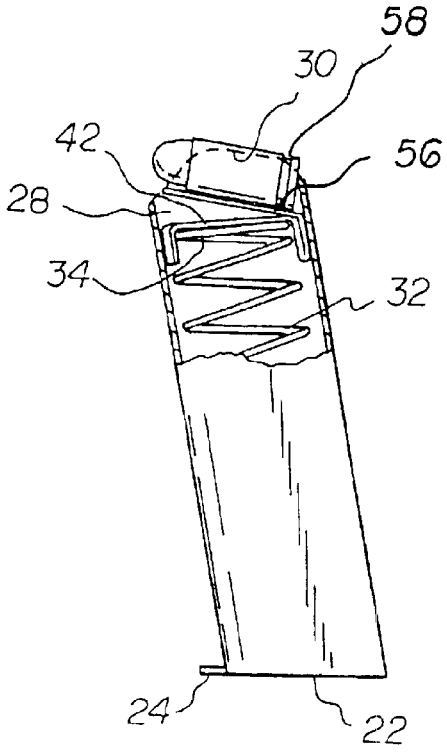
FIG. 1 is a side elevational view of a cartridge magazine system constructed in accordance with the principals of the present invention.
Figure 2:
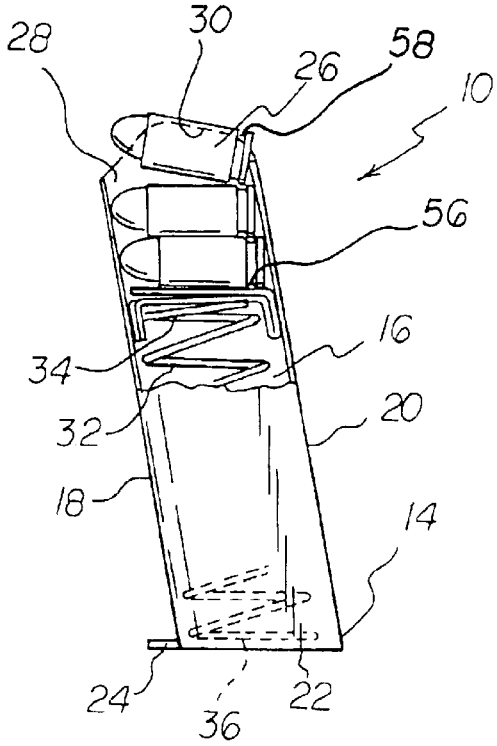
FIG. 2 is a side elevational view similar to FIG. 1 but with a plurality of bullets therein.

With reference now to the drawings, and in particular to FIG. 1 thereof, the preferred embodiment of the new and improved cartridge magazine system embodying the principles and concepts of the present invention and generally designated by the reference numeral 10 will be described.

The present invention, the cartridge magazine system 10 is comprised of a plurality of components. Such components in their broadest context include a case, a spring and a follower. Such components are individually configured and correlated with respect to each other so as to attain the desired objective.

First provided is a case 14. The case is fabricated of a heat treated stainless steel. The case is in a hollow generally rectilinear configuration. The case has two flat parallel side faces 16, a rounded front face 18 and a flat rear face 20. The case has a base end 22 with a base plate 24 and an open upper end 26. The base plate is formed in a flat generally rectangular configuration. The base plate is coupled to the base end to close the base end. In this manner an interior recess 28 within the case is formed. The upper ends of the side faces have a radial bevel to form a lip 30 on both sides. In this manner the opening into the recess of the case is restricted.

Next provided is a coil spring 32. The coil spring has an upper end 34 and a lower end 36. The upper and lower ends are positioned on the base plate and sized to be slightly longer than height of the interior recess of the case.

Provided last is a follower 42. The follower is positioned within the recess upon the spring. The follower is fabricated of a heat treated stainless steel and is sufficiently thin to provide a spring like resilience. The follower has a central section 44. The central section has a downwardly extending front leg 46. This front leg is curved to conform to the shape of the rounded front face of the case terminating in an arcuate lowermost extents The central section also has a downwardly extending flat rear leg 48 which conforms to the shape of the flat rear face of the case. The front leg and the central portion are less wide than the rear leg and the central section. The front and rear legs are adapted to smoothly slide downwardly without binding within the case with the addition of bullets to the recess and the compression of the spring. The front and rear legs are further adapted to smoothly slide upwardly without binding within the case with the removal of bullets from the case and the force of the spring. The central portion of the follower has a downwardly extending finger 38 for positioning the spring.

The lower end of the rear leg has a 180 degree bend with an upwardly extending portion 50. The upwardly extending portion terminates in an inwardly extending portion 52. The inwardly extending portion overlays the central portion and has a supplemental bend 54 between the upwardly extending portion and an inwardly extending portion. The inwardly extending portion is of between about 100 degrees and 105 degrees, preferably 103 degrees, when not compressed. The inwardly extending portion is resiliently movable into facing contact with the central portion when bullets are positioned within the recess.

Provided last is a dimple 56. The dimple is in a generally hemispherical configuration having a diameter of about 0.090 inches, plus or minus 10 percent, and a height of about 0.085 inches, plus or minus 10 percent. The dimple extends upwardly from the central section of the follower and is equally spaced laterally from the side faces of the case and the side edges of the central section. The dimple is located about 0.300 inches, plus or minus 10 percent, from the rear leg of the follower, to thereby fit into the annular recess 58 of a bullet there above.

The dimple is preferably formed by embossing. The dimple functions to extend the ability of the magazine to function over extended periods of time. More specifically, each time the firearm is discharged, the spring of the magazine is weakened. Such weakening may be noticed after about 500 loads which represents 3,500 rounds. At this point the spring is fatigued to the extent that the last round, the round in contact with the follower, can slip forward prior to the slide coming forward. This can allow the last round to come free from the magazine lip and pop up thereby being caught between the slide and the barrel vertically. The dimple of the present invention has no other affect on the function of the magazine except on the last round when it catches in the rim of the bullet. Tests indicate the present invention will extend the useful life of a magazine without the need of spring replacement or reworking from the about 4,000 to 5,000 rounds up to approximately 30,000 rounds.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A cartridge magazine system for allowing the user to safely load and use a firearm comprising, in combination;

a case fabricated of a heat treated stainless steel and having a hollow generally rectilinear configuration with two flat parallel side faces with each side face having upper end and a lower end and a rounded front face and a flat rear face with the case having a base end with a base plate and an open upper end, the base plate formed in a flat generally rectangular configuration and coupled to the base end to close the base end thereby forming an interior recess within the case, the upper ends of the side faces having a radial bevel to form a lip on both sides thereby restricting the opening into the recess of the case;

a coil spring having an upper end and a lower end positioned on the base plate and sized to be slightly longer than height of the interior recess of the case;

a follower positioned within the recess upon the spring and fabricated of a heat treated stainless steel and sufficiently thin to provide a spring-like resilience, the follower having a central section with side edges, with the central section having a downwardly extending front leg curved to conform to the shape of the rounded front face of the case, with the downwardly extending front leg of the central section terminating in an arcuate lowermost extent, the central section also having a downwardly extending flat rear leg to conform to the shape of the flat rear face of the case, the front leg and the central section there adjacent being less wide than the rear leg and the central section there adjacent, the front and rear legs adapted to smoothly slide downwardly without binding within the case with the addition of bullets to the recess and the compression of the spring and to smoothly slide upwardly without binding within the case with the removal of bullets from the case and the force of the spring, the rear leg having a lower end, the lower end having a 180 degree bend with an upwardly extending portion terminating in an inwardly extending portion overlying the central section of the follower, with a supplemental bend between the upwardly extending portion and the inwardly extending portion of between about 100 degrees and 105 degrees when not compressed but with the inwardly extending portion resiliently movable into facing contact with the central section of the follower when bullets are positioned within the recess, the central section of the follower having a downwardly extending finger for positioning the spring;

a dimple in a generally hemispherical configuration have a diameter of about 0.090 inches and a height of about 0.085 inches extending upwardly form the central section of the follower and equally spaced laterally from the side faces of the case and the side edges of the central section, the dimple being located about 0.300 inches for the rear leg of the follower.

2. A cartridge magazine system comprising;

a case having a hollow generally rectilinear configuration with two aide faces and a front face and a flat rear face with the case having a base end with a base plate and an open upper end thereby forming an interior recess;

a spring having an upper end and a lower end positioned on the base plate;

a follower positioned within the recess upon the spring with a central section having a front and a rear and an inwardly extending portion; and a dimple in a generally hemispherical configuration extending upwardly from the inwardly extending portion and located to thereby fit into an annular recess of a bullet there above, the dimple having a diameter of about 0.090 inches and a height of about 0.085 inches extending upwardly from the central section of the follower and equally spaced laterally from the side faces of the case, the dimple being located about 0.300 inches from the rear of the follower.

* * * * *